US008453708B2

(12) United States Patent
Rysholt

(10) Patent No.: US 8,453,708 B2
(45) Date of Patent: Jun. 4, 2013

(54) ADJUSTABLE ROLLER BLIND TUBE

(75) Inventor: Kim Rysholt, Kvaerndrup (DK)

(73) Assignee: Faber A/S, Ryslinge (DK)

( * ) Notice: Subject to any disclaimer, the term of this patent is extended or adjusted under 35 U.S.C. 154(b) by 245 days.

(21) Appl. No.: 12/920,518

(22) PCT Filed: Mar. 3, 2009

(86) PCT No.: PCT/DK2009/000059

§ 371 (c)(1),
(2), (4) Date: Jan. 6, 2011

(87) PCT Pub. No.: WO2009/109192

PCT Pub. Date: Sep. 11, 2009

(65) Prior Publication Data

US 2011/0192813 A1 Aug. 11, 2011

(30) Foreign Application Priority Data

Mar. 3, 2008 (DK) ..... 2008 00317

(51) Int. Cl.
*E06B 9/50* (2006.01)
*E06B 9/44* (2006.01)

(52) U.S. Cl.
USPC ..... 160/323.1; 160/325; 160/326; 160/263

(58) Field of Classification Search
USPC ..... 160/323.1, 24, 324, 325, 326, 263; 248/292.12, 292.13, 292.14, 252, 269; 403/329, 403/DIG. 14
See application file for complete search history.

(56) References Cited

U.S. PATENT DOCUMENTS

| | | | | |
|---|---|---|---|---|
| 2,009,761 | A * | 7/1935 | Calderara | 222/92 |
| 3,099,916 | A * | 8/1963 | Rosenbaum | 160/323.1 |
| 3,362,461 | A * | 1/1968 | Stark | 160/323.1 |
| 4,399,857 | A * | 8/1983 | Honma | 160/323.1 |
| 5,029,629 | A * | 7/1991 | Cheng-Pei | 160/300 |
| 5,031,682 | A * | 7/1991 | Tedeschi | 160/315 |
| 5,813,449 | A * | 9/1998 | Patmore et al. | 160/370.22 |
| 7,104,098 | B2 * | 9/2006 | Romero et al. | 70/224 |
| 7,201,417 | B2 * | 4/2007 | Teo | 296/24.4 |
| 7,677,293 | B2 * | 3/2010 | Allsopp | 160/323.1 |
| 7,740,047 | B2 * | 6/2010 | Koop et al. | 160/323.1 |
| 8,151,859 | B2 * | 4/2012 | Koop et al. | 160/325 |
| 8,162,280 | B2 * | 4/2012 | Yu et al. | 248/354.7 |
| 8,210,766 | B2 * | 7/2012 | Schermer et al. | 403/329 |

(Continued)

FOREIGN PATENT DOCUMENTS

| | | | |
|---|---|---|---|
| DE | 29500491 | U1 | 6/1995 |
| EP | 1 103 694 | A1 | 5/2001 |
| WO | WO 2009109192 | A1 * | 9/2009 |

OTHER PUBLICATIONS

International Search Report for Appl. No. PCT/DK2009/000059.

*Primary Examiner* — Blair Johnson
*Assistant Examiner* — Jaime F Cardenas-Garcia
(74) *Attorney, Agent, or Firm* — Pearne & Gordon LLP

(57) ABSTRACT

In order to facilitate mounting of a roller blind one end of the roller blind tube is fitted with a spring-loaded insert (M). To prevent this from being pushed back a grub screw may be used, but it requires tools and precise alignment. According to the invention a releasable pawl-and-ratchet structure (2, 4) is provided in the end plug (1). The release is obtained by rotating the holder (5) of the pawls (2), whereby they are directed into axial grooves (3 or 3').

13 Claims, 4 Drawing Sheets

U.S. PATENT DOCUMENTS

Figure 1:
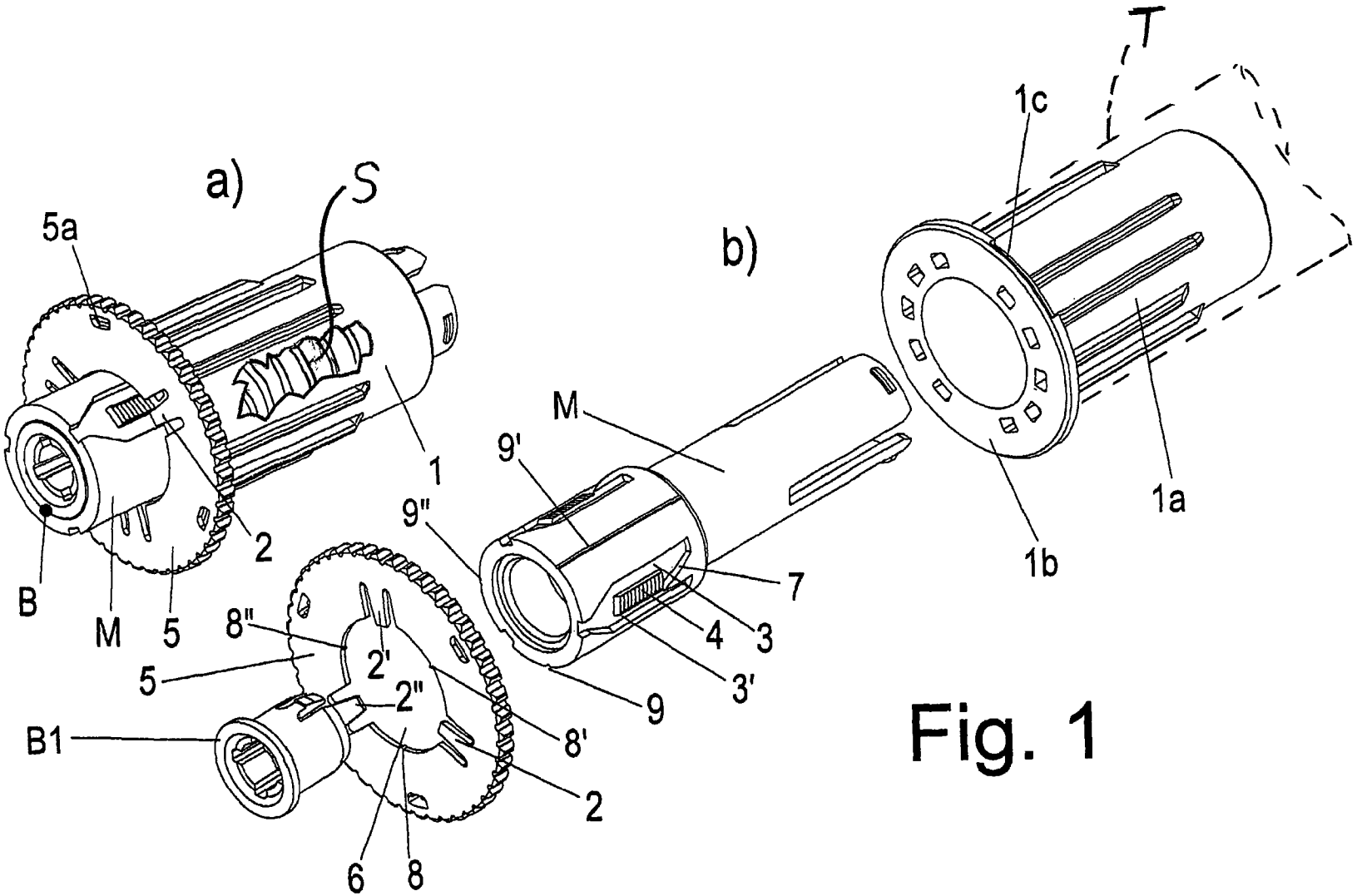

2006/0102823 A1* 5/2006 Carnevali ..... 248/534
2007/0075202 A1* 4/2007 Gordon ..... 248/289.11
2008/0121353 A1* 5/2008 Detmer et al. ..... 160/266
2008/0142171 A1* 6/2008 Koop et al. ..... 160/243
2010/0102186 A1* 4/2010 Keyvanloo ..... 248/224.7
2010/0236730 A1* 9/2010 Koop et al. ..... 160/323.1
2011/0192813 A1* 8/2011 Rysholt ..... 211/123
2012/0193042 A1* 8/2012 Koop et al. ..... 160/323.1

* cited by examiner

ADJUSTABLE ROLLER BLIND TUBE

The invention relates to a roller blind tube that is supported by means of end plugs in brackets, in which one end plug is provided with an axially spring loaded insert and the other end plug may be connected to a drive mechanism.

An important feature of a roller blind is that it shall fit correctly between its carrying brackets so that there is no risk of sideways movement. Traditionally, this was obtained by using the correct length of roller blind tube, with one end plug having a circular boss that fitted into a circular hole in one bracket and the other end plug carrying an internal spring mechanism ending in a flat shaft end that was hung into a slit that prevented its turning. Modern roller blinds do not necessarily have an internal spring mechanism, but may rather be operated by a raising and lowering ball string. In that case, there is no need to prevent rotation of the shaft of an internal spring mechanism.

Instead of the requirement that a roller blind tube is cut to a pre-determined length before installing, there is a possibility of using a spring-loaded end plug, which permits installing the roller blind between brackets having totally closed openings, such as circular holes. One end of an end plug is simply inserted into one bracket, the spring is slightly compressed, and the end of the other end plug is inserted in the other bracket. In a further development of this prior art each bracket has a flat extension coaxial with the roller blind tube, upon which is fitted an inner plug that the end plug may rotate upon. This will permit locking the roller blind in any position by means of the operating ball string mechanism.

However, even the spring loaded end plug will allow sideways movement of the roller blind because some sideways forces may overcome the spring force, and in a worst case scenario the roller blind may be pulled from its brackets and fall down. There is hence a need to lock the extension of the spring-loaded end plug when the play between the roller blind tube and the brackets has been eliminated. Known solutions comprise the use of a grub screw, but this requires precise orientation both when tightening and loosening the locking mechanism. Another solution to this problem is described in DE29500491U1, in which a shaft extender is lockable in two positions by rotation, however, this would not solve the problem of a desired length in between the two extremes. There is hence a need for a mechanism that avoids this disadvantage.

According to the invention this disadvantage is avoided in an adjustable roller blind tube that is particular in that in the end plug at least one spring loaded pawl means mounted on a pawl carrier that is coaxial with the roller blind tube either engages a cooperating axially disposed groove means in the insert in a first angular position or engages a cooperating axially disposed ratchet means in the insert in a second angular position, the at least one pawl means preventing, when it engages the ratchet means, the insert from retracting into the end plug, which would cause a shortening of the roller blind tube. When the pawls engage the ratchets, the insert is only free to assume the position it is urged to by the spring, and cannot return, but when the pawls engage the grooves, any axial movement is possible.

In an advantageous embodiment of the roller blind tube the at least one pawl means is brought out of engagement with the corresponding ratchet means by turning said pawl carrier on said spring-loaded insert. In this way, the pawls are released by pulling them sideways out of engagement with the ratchets.

In a further advantageous embodiment each of said ratchet means ends with a cam surface that acts on the at least one pawl means so that the pawl carrier rotates and directs the at least one pawl means into one end of said at least one groove means. This means that when the maximum extent of the length of the roller blind tube has been reached, the cam surface ensures that the pawls are positively moved sideways and into one of the grooves, to free the insert to move axially in both directions.

In a further advantageous embodiment each of said ratchet means has a groove on either side. This has the particular advantage that the rotation for sideways disengagement of the pawls with the ratchets may occur in both directions of rotation.

In a further advantageous embodiment three spring-loaded pawls are provided on said pawl carrier, each engaging grooves or ratchets, dependent on the angular position of the pawl carrier with respect to the insert. This serves to distribute the axial force transmitted via the pawl-and-ratchet mechanism.

In a further advantageous embodiment each ratchet ends with a cam surface that acts on the pawls so that said pawl carrier rotates and directs the pawls through a pre-determined groove. Again, providing this feature on each ratchet distributes the sideways force that is applied to the pawls and pawl carrier.

A further advantageous embodiment is particular in that said pawls are formed in a disc acting as a pawl carrier by means of cut-outs in a circular hole while retaining the disc on the flange of the end plug. This reduces the axial extent of the locking mechanism in order that a wider range of adjustments is made available.

In a further advantageous embodiment each ratchet ends with a cam surface that acts on the pawls so that the disc rotates and leads the pawls through a pre-determined one of said grooves. The cam surfaces ensure that the pawls are positively moved sideways and into one of the grooves, to free the insert to move axially in both directions.

A further advantageous embodiment is particular in that elements carried by said pawl carrier and said insert cooperate to maintain their relative rotational position when said pawl means engage said ratchet means unless a sufficient rotational force is applied to said pawl carrier. This is intended to ensure that the whole width of pawls is used on the ratchets, and that it requires a positive rotational force to bring them out of engagement.

In an advantageous embodiment the elements carried by the pawl carrier are one or several projections and the elements carried by the insert are one or several axial grooves fitted at angular distances corresponding to the projections. The projections will be able to slide axially in the grooves, but a certain turning force will permit rotation to disengage the pawls from the ratchets.

In a further advantageous embodiment the elements carried by the pawl carrier are one or several depressions and the elements carried by the insert are one or several axial ridges fitted at angular distances corresponding to the depressions. This is the inverse of the embodiment described above and it has particular advantages when the lengths of the ridges are essentially equal to the length of the ratchets, because this means that the ridge-depression engagement can only occur when the pawls are in engagement with the ratchets.

In a further advantageous embodiment the pawl carrier is retained on the flange of the end plug in a manner that restricts its rotation on said end plug to an interval essentially corresponding to the angular distance between said grooves on either side of said ratchet means and provided by a reduced thickness of the flange in 3 intervals. This is a manner to retain the axially very short construction while permitting all the movements necessary to operate the device.

Figure 2:
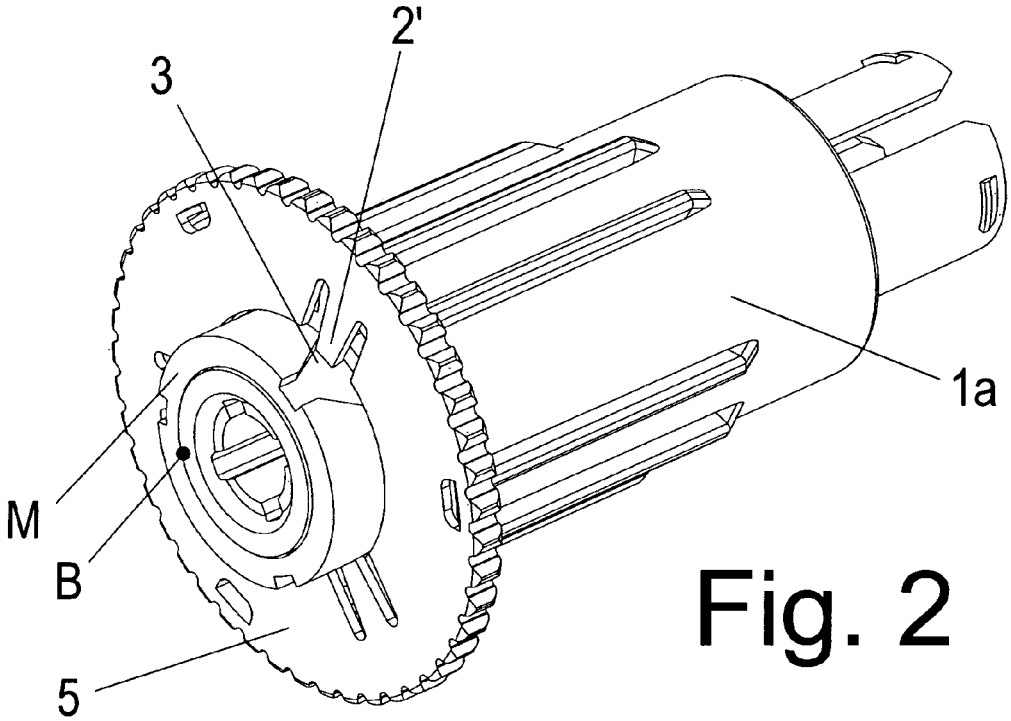
Figure 3:
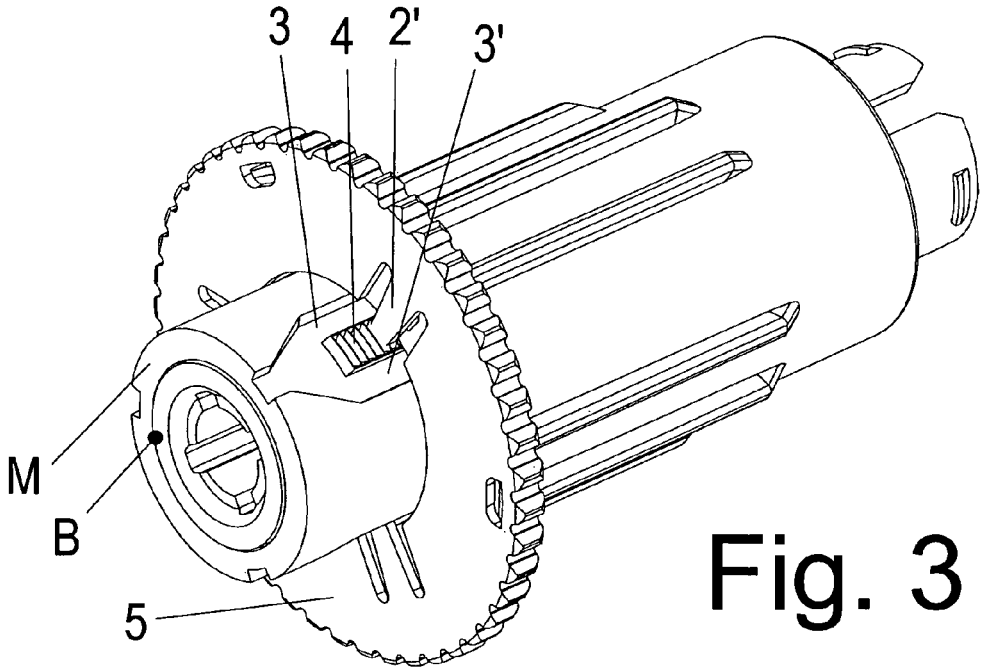
Figure 4:
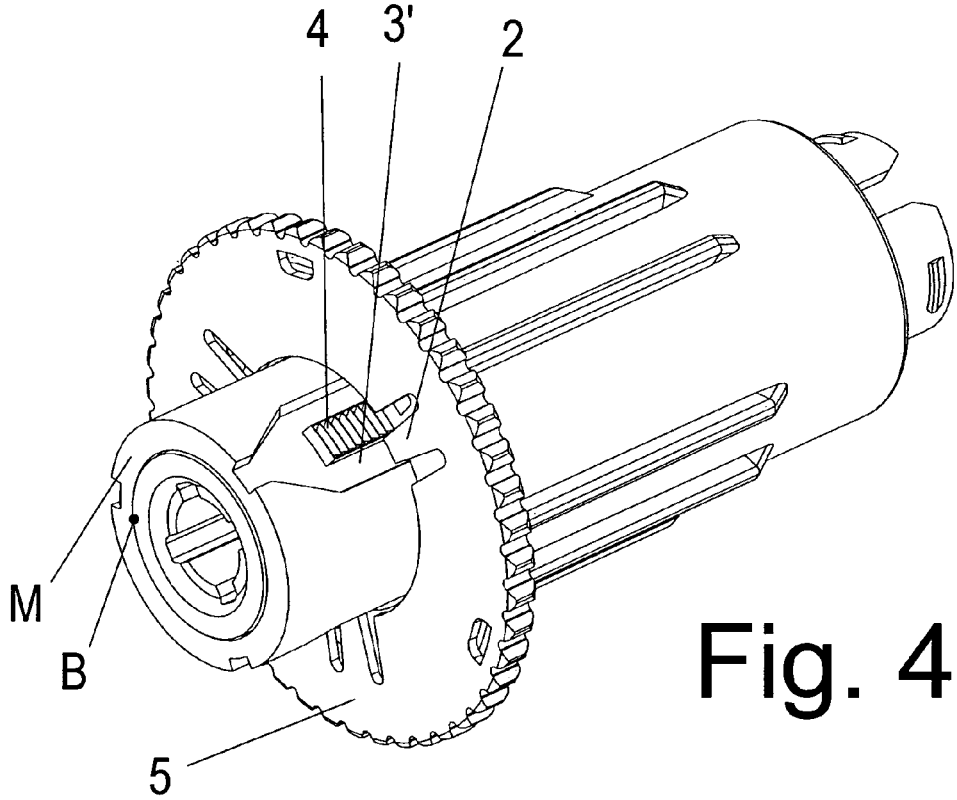
Figure 5:
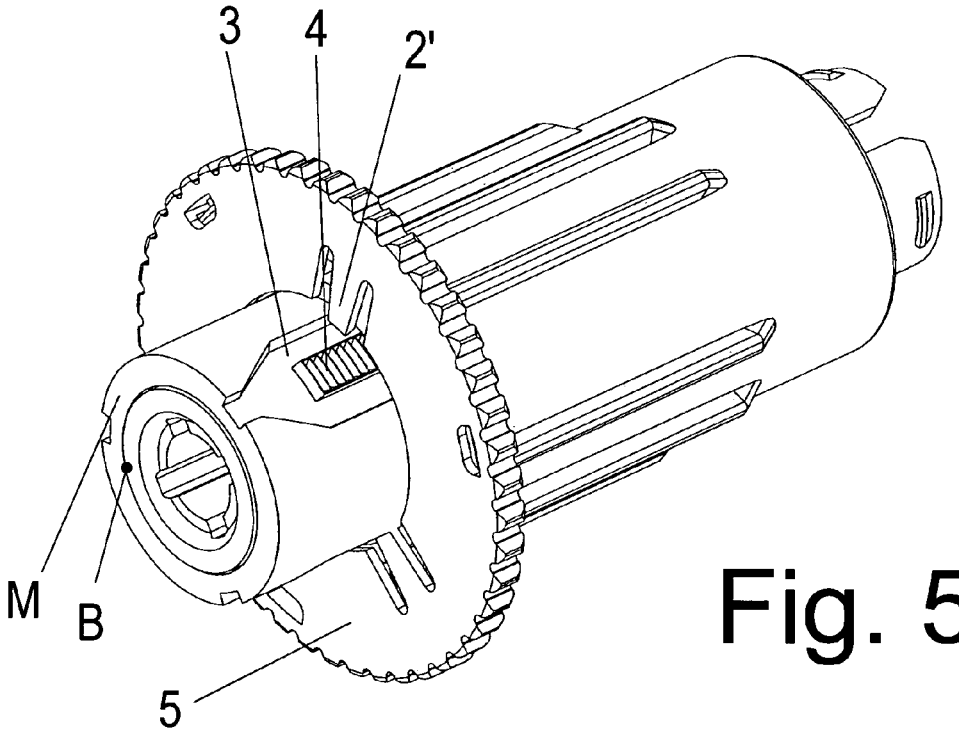
Figure 6:
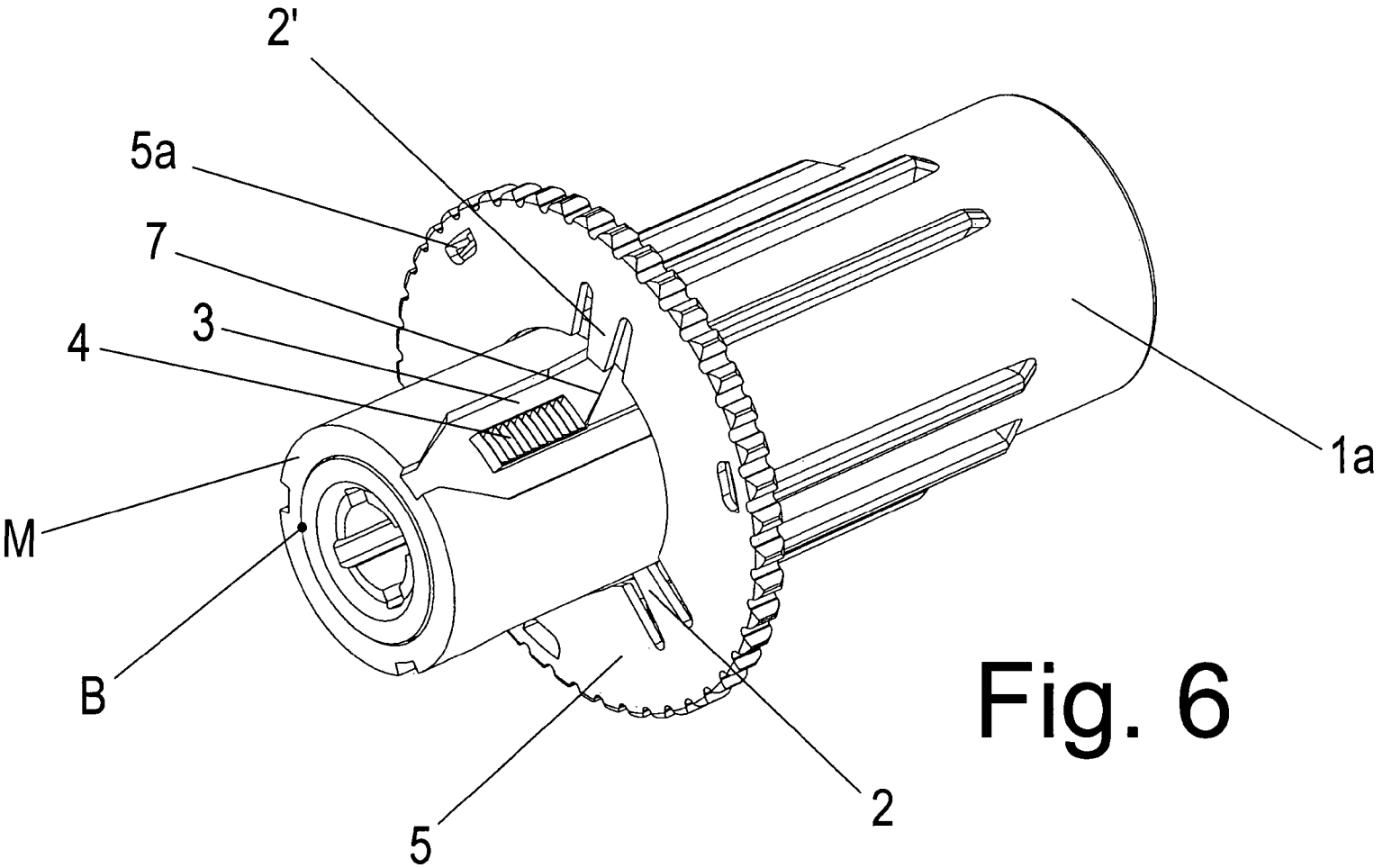

The invention will be described in greater detail with reference to the drawings, in which FIG. 1 is a general layout of component parts of the adjustable roller blind tube, FIG. 2 is shows the operating parts when the spring is fully compressed, FIG. 3 shows the operating parts when the pawl engages the ratchet, FIG. 4 shows the operating parts when the disc has been turned one way, FIG. 5 shows the operating parts when the disc has been turned the other way, and FIG. 6 shows the operating parts when the roller blind tube has its greatest length, and the cam surface has pushed the pawl into one of the grooves.

In FIG. 1 is seen an embodiment of the invention in the form of an assembled end plug 1 at a) and an exploded view at b). The end plug 1 consists of an outer sleeve part 1*a* that is fitted into one end of a generally cylindrical roller blind tube T that is not shown. Inside the sleeve part 1*a* there is a spring-loaded moveable insert M, including spring element S, in the form of a piston-like element that may move axially in or out of the outer sleeve 1*a*. A flange portion 1*b* is provided perpendicular to the sleeve 1*a*. The spring acts in the direction corresponding to 'left' in the figure. In the centre of the insert M there is provided a sleeve bearing B, the centre part B1 of which is held by a bracket, and which permits the roller blind tube to rotate. The piston-like element carries three sets of ratchet mechanisms 3, 4, 3', with a ratchet 4 between two grooves 3, 3'. The ratchet 4 ends in a ramp-like cam surface 7 that forces any object, such as a pawl, to be directed sideways into the groove 3 at the end of an axial movement along the ratchet. A pawl structure is provided by means of three pawls 2, 2', 2" pointing radially inwards into a hole 6 in a disc 5 that is hence a pawl carrier. In the present embodiment the disc has hooks 5*a* that engage the flange portion 1*b* of the outer sleeve 1*a*, but other means of providing the engagement of this disc will be obvious to the skilled person. The disc 5 may rotate to a limited extent on the flange 1*b* because the hooks 5*a* engage cut-outs of reduced thickness and limited peripheral length in the periphery of the flange 1*b*, of which only one cut-out, 1*c*, is shown. The radial extent of the pawls is such that they can simultaneously engage the three ratchets 4 while maintaining an orientation that is perpendicular to the axis of rotation of the roller blind. This is because the disc 5 is entirely parallel to the flange portion 1*b* of the plug 1.

When assembling the pieces shown in FIG. 1*b*) into the assembled end plug shown in FIG. 1*a*), a coiled spring (not shown) is placed on the spring-loaded insert M and inserted into the sleeve 1*a* until a self-locking mechanism retains it. The bearing sleeve part B1 is inserted into the spring-loaded insert until a self-locking mechanism retains it, and the disc 5 is fitted onto the spring-loaded insert M by entering the grooves axially at the end of the insert and clicking the hooks 5*a* around the flange 1*b*.

In order to maintain the pawls 2, 2', 2" squarely on the ratchets when they are in use and to prevent spurious rotation of the disc 5 that would cause release and to ensure minimum wear to the edges of the pawls the disc 5 is further provided with small projections 8, 8', 8" that correspond with shallow axially directed grooves 9 in the part M approximately midway between the groove-and-ratchet structures 3, 4, 3'. The projections provide resistance against rotation when the pawls are centred on the ratchets and provide a centering function. However, this resistance is overcome when the disc 5 is manually rotated one or the other way to release the pawls from the ratchets or when the rotation is forced by the pawls 2, 2', 2" being pushed sideways by the ramp-like cam surfaces 7. It is obvious that the same function may be obtained by the inverse solution: the disc 5 carries depressions and the part M carries ridges. The ridges are only needed when the pawls engage the ratchet, and for this reason they do not need to have a length that is greater than the length of the ratchets. It should be noted that the features of the centering function described above are not shown in FIGS. 2-6.

In FIG. 2 the pawl 2' is shown in the groove 3 while the spring-loaded insert M does not protrude very much. This is the starting position, while the opening in the bearing insert B is aligned with its opening towards an end of the carrying bracket. The bracket itself is not shown, because it would obstruct the view of the grooves and ratchet.

In FIG. 3 the pawl 2' is visibly engaging the ratchet 4, and the spring-loaded insert M protrudes further but cannot be pushed back into the sleeve 1*a*.

In FIG. 4 the pawl 2' has been brought out of engagement with the ratchet 4 by turning the disc 5 with respect to the spring-loaded insert M in what appears as a clockwise direction on the figure. The pawl 2' is now in the groove 3'. The piston-like element M may now be pushed into the sleeve 1*a*.

In FIG. 5 the pawl 2' has again been brought out of engagement with the ratchet 4, but the disc 5 has been turned counter-clockwise. Hence the pawls may be brought out of engagement with the ratchets irrespective of the direction of rotation.

In FIG. 6 it is shown what happens when the piston-like element M had reached its maximum extent and when the pawl 2' has reached the end of the ratchet 4. A slanted surface 7 has forced the turning of the disc 5 by acting on the pawl 2', so that it now has entered the groove 3. In this position the spring inside the sleeve 1*a* may again be compressed when the piston-like element M is pushed out in the lengthening direction for renewed adjustment.

Other embodiments are quite feasible under the definitions of the broadest claim, for instance the pawls may be separate from the carrier—in the embodiment above described as a disc 5—provided they are moveable radially in radial slots provided in the carrier and maintained in yielding contact with the ratchet by spring means, such as an elastomer band fitted concentrically around the assembly. Similarly it would fall under the definition of the broadest claim to fit each pawl on a tangential spring element fixed to an element equivalent to the disc 5.

To sum up: in order to facilitate mounting of a roller blind one end of the roller blind tube is fitted with a spring-loaded insert M. To prevent this from being pushed back a grub screw may be used, but it requires tools and precise alignment. According to one embodiment of the invention a releasable pawl-and-ratchet structure 2, 4 is provided in the end plug 1. The release is obtained by rotating the holder 5 of the pawls 2, whereby they are directed into axial grooves 3 or 3'.

The foregoing description of the specific embodiments will so fully reveal the general nature of the present invention that others skilled in the art can, by applying current knowledge, readily modify or adapt for various applications such specific embodiments without undue experimentation and without departing from the generic concept, and therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of forms without departing from the invention.

Thus, the expressions "means to . . . " and "means for . . . ", or any method step language, as may be found in the specification above and/or in the claims below, followed by a functional statement, are intended to define and cover whatever structural, physical, chemical, or electrical element or structure, or whatever method step, which may now or in the future exist which carries out the recited functions, whether or not precisely equivalent to the embodiment or embodiments disclosed in the specification above, i.e., other means or steps for carrying out the same function can be used; and it is intended that such expressions be given their broadest interpretation.

The invention claimed is:

1. A roller blind tube of adjustable length that is supported by means of end plugs in brackets, in which one end plug is provided with an axially spring loaded insert and the other end plug may be connected to a drive mechanism, wherein in said end plug at least one spring loaded pawl means mounted on a pawl carrier that is coaxial with the roller blind tube alternatively engages a cooperating axially disposed groove means in the insert in a first angular position and engages a cooperating axially disposed ratchet means in the insert in a second angular position radially disposed from the first angular position, said at least one pawl means preventing, when it engages said ratchet means, the insert from retracting into the end plug, which would cause a shortening of the roller blind tube.

2. A roller blind tube according to claim 1, wherein the at least one pawl means is brought out of engagement with the corresponding ratchet means by turning said pawl carrier on said spring-loaded insert.

3. A roller blind tube according to claim 1, wherein each of said ratchet means ends with a cam surface that acts on the at least one pawl means so that the pawl carrier rotates and directs the at least one pawl means into one end of said at least one groove means.

4. A roller blind tube according to any of the above claims claim 1, wherein each of said ratchet means has a groove on either side.

5. A roller blind tube according to any of the above claims claim 1, wherein three spring loaded pawls are provided on said pawl carrier, each engaging grooves or ratchets, dependent on the angular position of the pawl carrier with respect to the insert.

6. A roller blind tube according to claim 3, wherein each ratchet ends with a cam surface that acts on a respective one of said pawls so that said pawl carrier rotates and directs the pawls through a pre-determined groove.

7. A roller blind tube according to claim 5, wherein said pawls are formed in a disc acting as a pawl carrier by means of cut-outs in a circular hole while retaining the disc on the flange of the end plug.

8. A roller blind tube according to claim 7, wherein each ratchet ends with a cam surface that acts on the pawls so that the disc rotates and leads the pawls through a pre-determined one of said grooves.

9. A roller blind tube according to any of the above claims claim 1, wherein elements carried by said pawl carrier and said insert cooperate to maintain their relative rotational position when said pawl means engage said ratchet means unless a sufficient rotational force is applied to said pawl carrier.

10. A roller blind tube according to claim 9, wherein the elements carried by the pawl carrier are one or several projections and the elements carried by the insert are one or several axial grooves fitted at angular distances corresponding to the projections.

11. A roller blind tube according to claim 9, wherein the elements carried by the pawl carrier are one or several depressions and the elements carried by the insert are one or several axial ridges fitted at angular distances corresponding to the depressions.

12. A roller blind tube according to claim 11, wherein the lengths of the ridges are essentially equal to the length of the ratchets.

13. A roller blind tube according to claim 7, wherein the pawl carrier is retained on the flange of the end plug in a manner that restricts its rotation on said end plug to an interval essentially corresponding to the angular distance between said grooves on either side of said ratchet means and provided by a reduced thickness of the flange in 3 intervals.

* * * * *

UNITED STATES PATENT AND TRADEMARK OFFICE

CERTIFICATE OF CORRECTION

PATENT NO. : 8,453,708 B2
APPLICATION NO. : 12/920518
DATED : June 4, 2013
INVENTOR(S) : Kim Rysholt It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 369 days.

Signed and Sealed this
Eighth Day of September, 2015

Michelle K. Lee

Michelle K. Lee
*Director of the United States Patent and Trademark Office*